United States Patent [19]

Jelinek et al.

[11] 4,423,947

[45] Jan. 3, 1984

[54] RACK FOR TRANSPORTING PHOTOSENSITIVE MATERIAL THROUGH A BATH

[75] Inventors: Nikolaus Jelinek; Hans Ketterer; Helmut Schausberger, all of Munich, Fed. Rep. of Germany

[73] Assignee: Agfa-Gevaert Aktiengesellschaft, Leverkusen, Fed. Rep. of Germany

[21] Appl. No.: 417,707

[22] Filed: Sep. 13, 1982

[30] Foreign Application Priority Data

Nov. 27, 1981 [DE] Fed. Rep. of Germany ... 8134723[U]

[51] Int. Cl.[3] ..... G03D 3/08

[52] U.S. Cl. ..... 354/320; 226/189; 134/122 P

[58] Field of Search ..... 354/316, 320, 321, 322; 226/189; 134/64 P, 122 P

[56] References Cited

U.S. PATENT DOCUMENTS

| | | | |
|---|---|---|---|
| 3,078,024 | 2/1963 | Sardeson | 226/189 |
| 3,435,749 | 4/1969 | Cauwe et al. | 226/189 |
| 4,358,194 | 11/1982 | Krehbiel | 354/320 |

*Primary Examiner*—A. A. Mathews

*Attorney, Agent, or Firm*—Kontler, Grimes & Battersby

[57] ABSTRACT

A transporting device for advancing photosensitive material through a processing bath has an upper portion and a lower portion. The upper portion has an inlet region via which the photosensitive material is introduced into the bath and an outlet region via which the photosensitive material is withdrawn from the bath. The inlet and outlet regions are located above the level of the bath. The inlet region has a pair of directing rollers which convey and guide the photosensitive material to the lower portion of the transporting device while the outlet region similarly has a pair of directing rollers which convey and guide the photosensitive material away from the lower portion. The lower portion of the transporting device has several sets of transporting rollers which advance the photosensitive material through the bath. The upper and lower portions of the transporting device are designed as separable units. This permits the upper portion, which requires more frequent cleaning than the lower portion, to be removed from the latter for cleaning purposes.

23 Claims, 4 Drawing Figures

RACK FOR TRANSPORTING PHOTOSENSITIVE MATERIAL THROUGH A BATH

BACKGROUND OF THE INVENTION

The invention relates generally to a processing arrangement, especially an apparatus for developing photosensitive material such as strips and/or sheets of film.

More particularly, the invention relates to a transporting device for advancing articles through a processing bath.

A conventional apparatus for developing photosensitive material has a series of vessels which accommodate the various baths used during processing. The photosensitive material is conveyed through the respective baths along looped or U-shaped paths.

One or more transporting devices located in each vessel serve to convey the photosensitive material therethrough. These transporting devices are also known as racks. The racks are held in the vessels by holding devices which are releasable so that the racks may be removed for cleaning purposes. It is primarily the racks, as opposed to the vessels, which require cleaning and, in particular, the upper portions of the racks which are located above the respective baths.

The upper portion of a rack includes inlet and outlet openings for the photosensitive material. In addition, the upper portion is provided with guide means such as pairs of conveying rollers, deflecting devices or the like for guiding the photosensitive material into and out of the lower portion of the rack. The lower portion of the rack, which is situated in the bath, is equipped with pairs of transporting rollers for advancing the photosensitive material through the bath.

The guide means in the upper portion of the rack is wetted by the liquid constituting the bath. The composition of the bath is such that crystallization occurs on the guide means when this is wetted by the liquid of the bath. For this reason, it is particularly important to clean the upper portion of the rack. The transporting rollers in the lower portion of the rack, that is, the portion of the rack located below the surface of the bath, are not affected by crystallization. Furthermore, by virtue of the fact that the bath is agitated, such transporting rollers may also be kept free of deposits other than crystals for a much longer time than the guide means in the upper portion of the rack.

The presence of crystals greatly affects the bath and the rack must be removed from the bath daily for cleaning. Due to the ever-increasing size, particularly width, of developing apparatus for photosensitive material, the weight of the rack has increased so that it can no longer be readily removed by hand.

OBJECTS AND SUMMARY OF THE INVENTION

It is an object of the invention to provide a transporting device which is designed so that the portion located externally of the bath may be readily cleaned.

Another object of the invention is to provide a transporting device which is designed so that the portion thereof located externally of the bath may be made accessible for cleaning in a simple manner.

An additional object of the invention is to provide a transporting device which is designed so that the portion thereof located externally of the bath may be easily made accessible by hand for the purpose of cleaning the same.

A concomitant object of the invention is to provide a transporting device of the type outlined above which is designed so that the portion thereof located externally of the bath may be cleaned more simply than comparable conventional transporting devices.

It is also an object of the invention to provide a processing arrangement having a transporting device which is designed so that the portion thereof located externally of the bath may be made accessible for cleaning more readily than heretofore.

A further object of the invention is to provide a developing apparatus for photosensitive material which includes a transporting device designed so that the portion thereof located externally of the bath may be cleaned in a simpler manner than corresponding portions of the transporting devices in conventional developing apparatus.

The preceding objects, as well as others which will become apparent as the description proceeds, are achieved by the invention.

One aspect of the invention resides in an arrangement for advancing articles through a bath. The arrangement comprises a submersible unit having transporting means designed to be immersed in and to convey the articles through the bath. The arrangement further comprises an exposed unit having an outlet region for the articles and the exposed unit is engageable with the submersible unit in such a manner that the outlet region is located externally of the bath. The exposed unit is separable from the submersible unit.

The exposed unit may also be provided with an inlet region for the articles. In such an event, the inlet region is advantageously arranged similarly to the outlet region, that is, the inlet region is advantageously arranged to be located externally of the bath when the exposed unit engages the submersible unit.

The outlet region and inlet region of the exposed unit may have respective directing means for guiding the articles. Such directing means may be in the form of pairs of conveying rollers.

The submersible unit may be designed to be immersed into the bath from above and the exposed unit may be designed to be situated on top of the submersible unit.

The transporting means constituting part of the submersible unit may include pairs of cooperating transporting rollers which define an approximately U-shaped path for the articles.

The submersible unit and the exposed unit may be provided with cooperating coupling means for releasably locking the units to one another.

In accordance with the invention, only a portion of the transporting device, i.e. only the exposed unit, need be removed for the daily cleaning. This removable portion or exposed unit may be designed in such a manner that it weighs no more than one-fifth of the transporting device.

The cooperating coupling means on the submersible unit and the exposed unit may be designed so that the units are unlocked in response to a force urging the units apart and are locked in response to a force urging the units together. By designing the coupling means in this fashion, no tools are required for separation of the exposed unit from the submersible unit.

Gripping means or handles may be provided on the exposed unit for disengaging the exposed unit from and engaging the same with the submersible unit. The gripping means may be located outside of the soiled region of the exposed unit. It is thus possible to manipulate the exposed unit in a simple and sanitary manner.

The gripping means may be connected with the coupling means on the exposed unit in such a manner as to cause the submersible unit and the exposed unit to become unlocked when the gripping means is manipulated to remove the exposed unit from the submersible unit and as to cause the submersible unit and the exposed unit to become locked when the gripping means is manipulated to engage the exposed unit with the submersible unit.

The novel features which are considered as characteristic of the invention are set forth in particular in the appended claims. The improved transporting device and processing arrangement, however, will be best understood upon perusal of the following detailed description of certain specific embodiments with reference to the accompanying drawings.

DESCRIPTION OF THE PREFERRED EMBODIMENTS

The transporting device of the invention is well-suited for use in developing apparatus for photosensitive material such as strips and/or sheets of film. The following description will be with reference to such developing apparatus by way of illustration and not by way of limitation.

Figure 1:
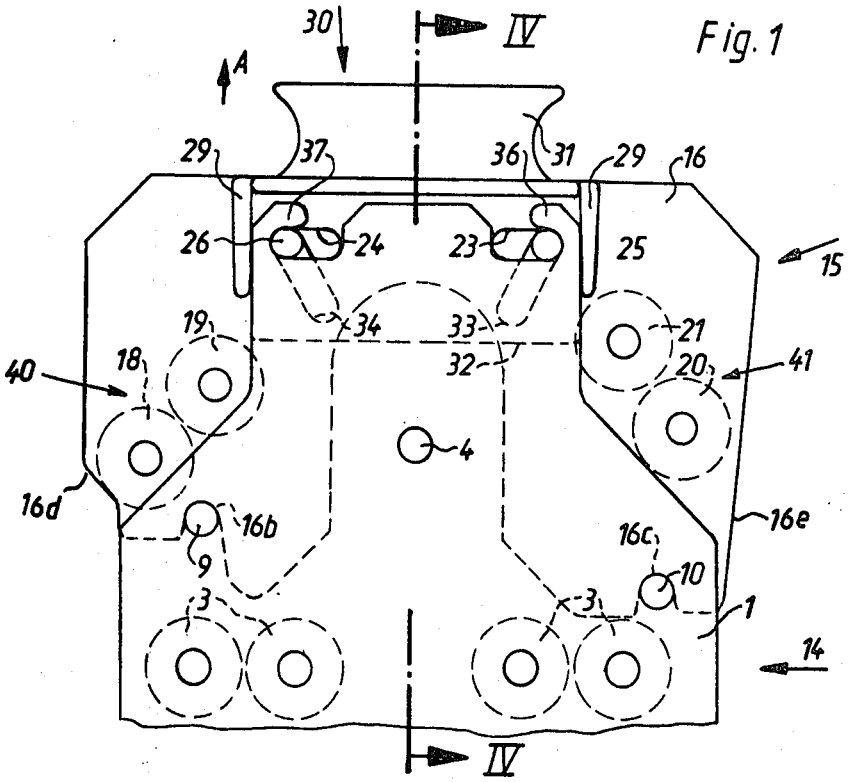
FIG. 1 is a side view of a transporting device according to the invention in the locked position.
Figure 2:
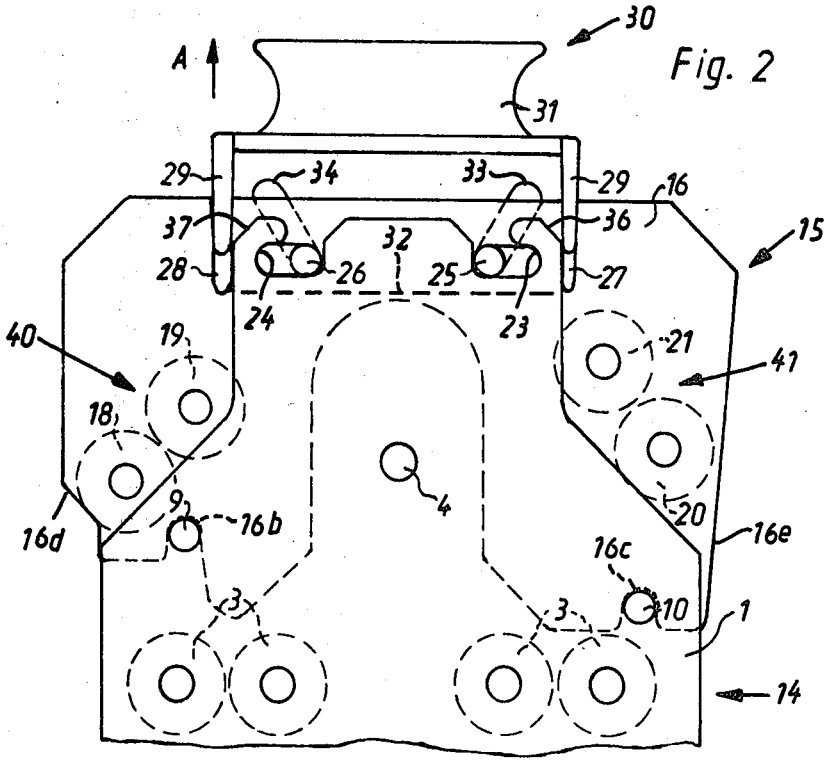
FIG. 2 is a view similar to FIG. 1 but illustrating the transporting device in its unlocked position.
Figure 3:
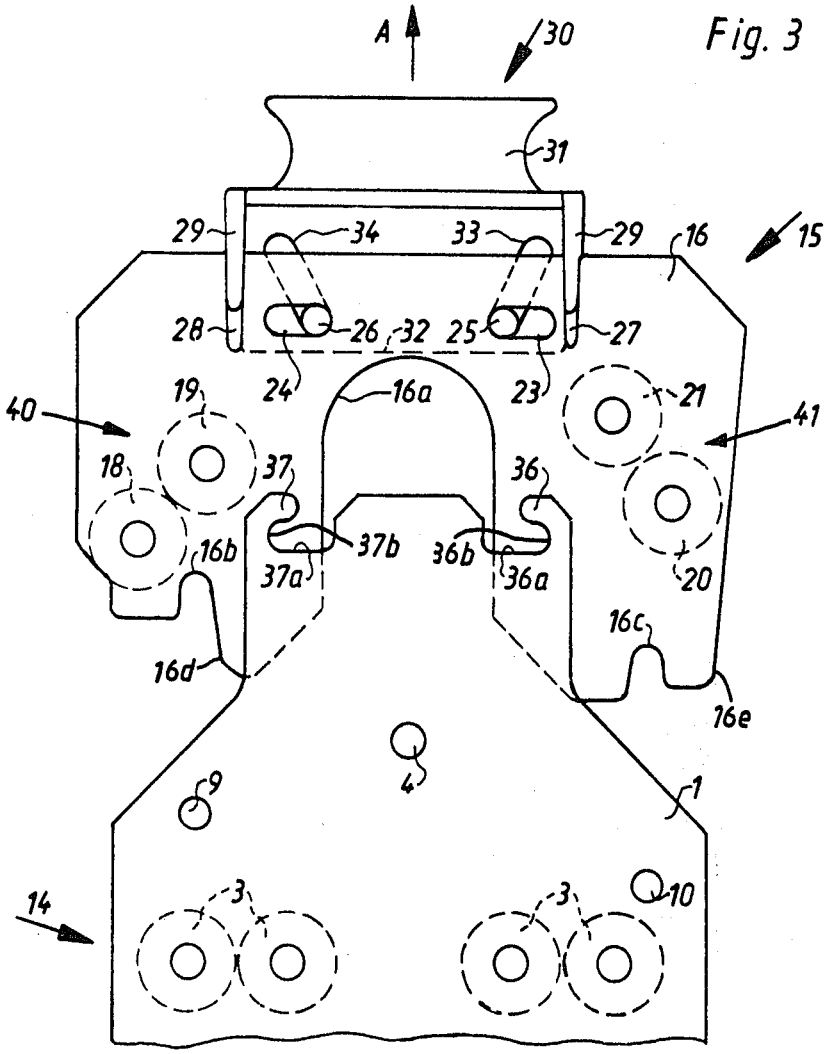
FIG. 3 is another view similar to FIG. 1 but illustrating the transporting device during separation of the exposed unit from the submersible unit.
Figure 4:
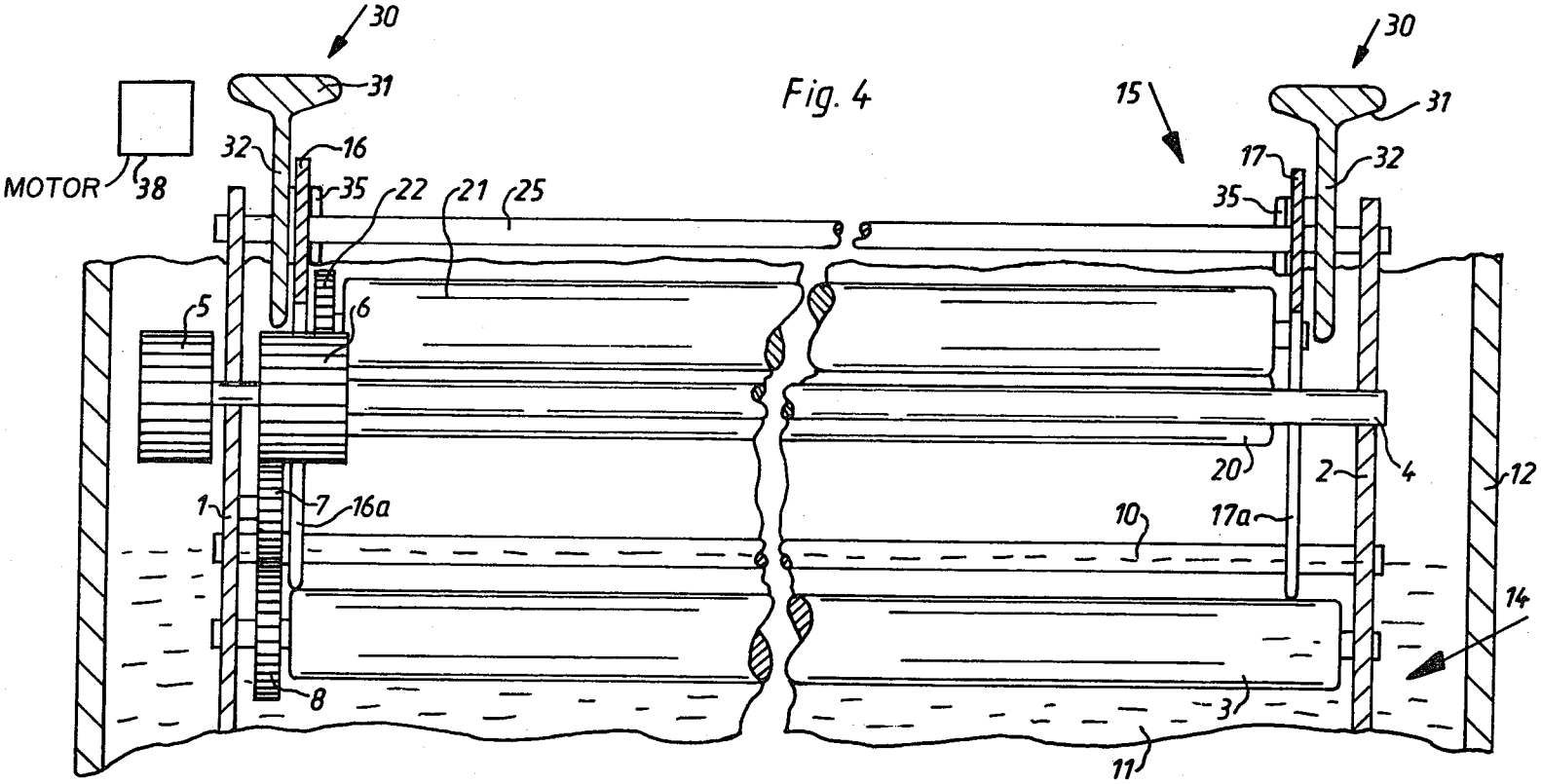
FIG. 4 is a cross-sectional view of a developing apparatus for photosensitive material equipped with the transporting device of FIG. 1 which is seen in the direction of the arrows IV—IV of FIG. 1.

As seen in FIGS. 1-3, the transporting device in accordance with the invention includes a lower or submersible unit 14 and an upper or exposed unit 15. FIG. 4 shows the transporting device 14,15 arranged in a processing bath 11 which is accommodated in a vessel 12. The transporting device 14,15 is designed to be immersed in the processing bath 11 from above. The predominant part of the lower unit 14 is submerged in the processing bath 11 while the predominant part of the upper unit 15 is situated above the level of the processing bath 11.

The vessel 12 and processing bath 11 constitute part of an apparatus for developing photosensitive material such as sheets and/or strips of film. The function of the transporting device 14,15 is to advance the photosensitive material through the processing bath 11.

The lower unit 14 includes a pair of support plates 1 and 2 which are arranged at opposite sides of the lower unit 14. The support plate 2, which is shown in FIG. 4, is maintained at a fixed distance from the support plate 1 by conventional, non-illustrated distancing elements. Transporting roller 3 for advancing the photosensitive material through the processing bath 11 extend between and are mounted on the support plates 1 and 2. The transporting rollers 3 are paired and the lower unit 14 is equipped with a plurality of pairs of the transporting rollers 3. The transporting rollers 3 are submerged in the processing bath 11 and the pairs of transporting rollers 3 are arranged in an approximately U-shaped pattern thereby defining an approximately U-shaped path for the photosensitive material in the processing bath 11.

A drive shaft 4 also extends between and is mounted on the support plates 1 and 2. The drive shaft 4 projects through the support plate 1 and the end of the drive shaft 4 located externally of the support plate 1 carries a driven gear 5. The driven gear 5 is connected with a conventional drive motor 38. The drive shaft 4 further carries a drive gear 6 internally of the support plate 1.

The drive gear 6 is coupled to transmission gears 7 which, in turn, mesh with respective driven gears 8. Only one each of the transmission gears 7 and driven gears 8 are shown in the drawings. A driven gear 8 is provided for each pair of transporting rollers 3 and is rigidly connected with one of the transporting rollers 3 of such pair.

Reinforcing rods 9 and 10 extend between and are fixed to the support plates 1 and 2.

In the illustrated embodiment, the lower unit 14 is constituted by the support plates 1 and 2, the transporting rollers 3, the drive shaft 4, the gears 5-8 and the reinforcing rods 9 and 10.

The upper unit 15, which is located on top of the lower unit 14, includes a pair of spaced support plates 16 and 17 which are arranged on opposite sides of the upper unit 15. Similarly to the support plates 1 and 2, the support plates 16 and 17 are maintained at a fixed distance from and connected with one another via conventional, non-illustrated elements such as rods or shafts.

The upper unit 15 has an inlet region 40 through which the photosensitive material to be processed in the processing bath 11 is introduced into the transporting device 14,15. A pair of directing or guiding rollers 18 and 19 is arranged in the inlet region 40. The directing rollers 18 and 19 extend between and are rotatably mounted on the support plates 16 and 17. The directing rollers 18 and 19 function to convey and guide the photosensitive material to the transporting rollers 3 of the lower unit 14.

The directing roller 19 is rigidly connected with a non-illustrated driven gear which meshes with a non-illustrated transmission gear. The latter, in turn, engages the drive gear 6.

The upper unit 15 further has an outlet region 41 via which the photosensitive material which has been processed in the processing bath 11 is withdrawn from the transporting device 14, 15. Another pair of directing or guiding rollers 20 and 21 is arranged in the outlet region 41. The directing rollers 20 and 21 extend between and are rotatably mounted on the support plates 16 and 17. The directing rollers 20 and 21 function to convey and guide the photosensitive material away from the transporting rollers 3 of the lower unit 14.

The directing roller 21 is rigidly connected with a driven gear 22 which meshes with a non-illustrated transmission gear. The transmission gear, in turn, engages the drive gear 6.

The inlet region 40 and the outlet region 41 of the upper unit 15 are located above the surface of the processing bath 11.

An arched cutout **16*a* is provided in the center of the support plate 16 while an arched cutout 17*a* is provided in the center of the support plate 17. The cutout 16*a* is bounded by a pair of legs 16*d* and 16*e* formed on the support plate 16. A similar pair of legs formed on the support plate 17 but not seen in the drawings bounds the cutout 17***a*. The support plates 16 and 17 thus have approximately n-shaped configurations. The drive gear 6 is situated in the cutout 16*a* whereas the drive shaft 4 extends through the cutout 16*a* as well as the cutout 17*a*.

A recess 16*b* is formed in the lower surface of the leg 16*d* while a recess 16*c* is formed in the lower surface of the leg 16*e*. Similar recesses are formed in the lower surfaces of the corresponding legs of the support plate 17. The recess 16*b* and the corresponding recess on the support plate 17 engage the reinforcing rod 9. On the other hand, the recess 16*c* and the corresponding recess on the support plate 17 engage the reinforcing rod 10. This causes the upper unit 15 to be properly positioned relative to the lower unit 14.

As shown in FIGS. 2 and 3, vertical grooves 27 and 28 are formed in the upper surface of the support plate 16. A similar pair of grooves is formed in the upper surface of the support plate 17. The grooves 27 and 28 of the support plate 16 receive legs 29 constituting part of a handle or gripping member 30. An identical handle or gripping member 30 is mounted in the grooves of the support plate 17. Each of the handles 30 includes a gripping section 31 which is designed to be grasped by the hand of an operator. Each of the handles 30 further includes a flat section 32 which is substantially parallel to the support plates 16 and 17. The flat section 32 of each handle 30 is located to one side of the respective support plate 16 or 17. A hook-like or bent section 35 projects from the flat section 32 of each handle 30 towards the associated support plate 16 or 17. The hook-like section 35 embraces the respective support plate 16 or 17 thereby guiding the associated handle 30 for movement in a vertical direction.

The flat section 32 of the handle 30 associated with the support plate 16 is provided with a pair of inclined receiving grooves 33 and 34. The receiving grooves 33 and 34 are upwardly and outwardly inclined as considered in a direction from the center of the flat section 32 to its sides. The receiving grooves 33 and 34 may, for example, be inclined to the vertical at an angle of approximately 30 degrees. The flat section 32 of the handle 30 associated with the support plate 17 is provided with a pair of receiving grooves identical to the receiving grooves 33 and 34.

A pair of horizontal guide grooves 23 and 24 is formed in the upper portion of the support plate 16. The guide grooves 23 and 24 are spaced from one another and are arranged at the same height. An identical pair of guide grooves is formed in the support plate 17.

A coupling rod 25 extends between the support plates 16 and 17 and projects through the receiving groove 33 and the guide groove 23 as well as the corresponding grooves at the support plate 17. Similarly, a coupling rod 26 extends between the support plates 16 and 17 and projects through the receiving groove 34 and the guide groove 24 as well as the corresponding grooves at the support plate 17.

In the illustrated embodiment, the upper unit 15 is constituted by the support plates 16 and 17, the directing rollers 18-21, the driven gear 22 on the directing roller 21 as well as the corresponding driven gear on the directing roller 19, the coupling rods 25 and 26 and the handles 30.

The upper end of the support plate 1 is provided with a pair of hooks 36 and 37. The hook 36 includes an arcuate portion 36*b* having an inner radius which approximates the radius of the coupling rod 25. Similarly, the hook 37 comprises an arcuate portion 37*b* having an inner radius which approximates the radius of the coupling rod 36. The arcuate portion 36*b* of the hook 36 merges into a horizontal guide surface 36*a* while the arcuate portion 37*b* of the hook 37 merges into a horizontal guide surface 37*a*. When the upper unit 15 is properly positioned on the lower unit 14, the guide surface 36*a* registers with the lower horizontal surface of the guide groove 23. On the other hand, the guide surface 37*a* registers with the lower horizontal surface of the guide groove 24. The support plate 2 is provided with a pair of hooks identical to the hooks 36 and 37.

FIG. 1 illustrates the operating condition of the transporting device 14,15. The upper unit 15 is situated on top of the lower unit 14 and the recesses 16*b* and 16*c*, as well as the corresponding recesses in the support plate 17, respectively receive the reinforcing rods 9 and 10. The driven gear 22 for the directing roller 21 as well as the corresponding gear for the directing roller 19 are coupled to the drive gear 6. Furthermore, the upper unit 15 is locked to the lower unit 14 by virtue of the fact that the coupling rods 25 and 26 are engaged by the respective hooks 36 and 37 as well as the corresponding hooks on the support plate 2.

In order to disengage the upper unit 15 from the lower unit 14, it is merely necessary to pull the handles 30 upwardly as indicated by the arrow "A". As shown in FIGS. 2 and 3 for the handle 30 which is mounted on the support plate 16, the upward pull on the handle 30 results in sliding movement of the legs 29 in the slots 27 and 28. The same sliding movement occurs for the handle 30 which is mounted on the support plate 17. The handles 30 thus move vertically while the remainder of the upper unit 15 remains stationary.

Due to the link-like or lever-like guidance offered by the inclined receiving slots 33 and 34, as well as the corresponding receiving slots in the handle 30 which is mounted on the support plate 17, the coupling rods 25 and 26 are displaced inwardly towards one another as the handles 30 are raised. Consequently, the coupling rods 25 and 25 move out of engagement with the hooks 36 and 37 and the corresponding hooks on the support plate 2. This situation is illustrated in FIG. 2. Once the coupling rods 25 and 26 have been disengaged from the hooks 36 and 37 and the corresponding hooks on the support plate 2, the upper unit 15 is unlocked from the lower unit 14. By continuing to pull on the handles 30 in the direction of the arrow "A", the upper unit 15 may be separated from the lower unit 14 as shown in FIG. 3.

After separation of the upper unit 15 from the lower unit 14, the upper unit 15 may be cleaned.

When the upper unit 15 has been cleaned, it may once again be placed upon the lower unit 14. The upper unit 15 is lowered onto the lower unit 14 in such a manner that the recesses 16*b* and 16*c* as well as the corresponding recesses in the support plate 17 engage the respective reinforcing rods 9 and 10. When the recesses 16*b*,16*c* and the corresponding recesses in the support plate 17 are in engagement with the respective reinforcing rods 9 and 10, the coupling rods 25,26 rest upon the horizontal surfaces 36*a*,37*a* of the hooks 36,37 and also upon the corresponding horizontal surfaces of the hooks on the support plate 2. If the handles 30 are now pushed downwardly, that is, in a direction opposite to that indicated by the arrow "A", the receiving slots 33,34 and the corresponding slots in the handle 30 which is mounted on the support plate 17 are forced downwards. As a result, the coupling rods 25,26 are displaced outwardly away from one another along the guide slots 23,24 and the corresponding guide slots in the support plate 17. This causes the coupling rods 25,26 to engage the hooks 36,37 and the corresponding hooks on the support plate 2. The upper unit 15 is thus locked to the lower unit 14.

When the upper unit 15 is lowered onto the lower unit 14, the driven gear 22 on the directing roller 21 as well as the driven gear on the directing roller 19 are coupled to the drive gear 6.

In the illustrated embodiment, the transporting device is divided into two units which may be separated from one another. However, it is possible to divide a transporting device into more than two units and to equip each unit with coupling means of the type described herein. This enables very heavy transporting devices to be installed and removed in a simple manner. Division of a transporting device into several units is also advantageous when transporting devices of different sizes are required for different applications. This makes it possible to combine as few or as many units as are necessary for a particular application. In the event that a transporting device is divided into more than two units, the shape of the handles will depend upon the space which is available.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for advancing articles through a bath comprising:

(a) a submersible first unit having transporting means designed to be immersed in and to convey the articles through the bath;

(b) a second unit having an outlet region for the articles and being engageable with said first unit in such a manner that said outlet region is located externally of the bath, said second unit being separable from said first unit and including gripping means for gripping the same, and said gripping means being movable relative to the remainder of said second unit; and (c) cooperating coupling means on said units for releasably locking said units to one another, said coupling means comprising a rod on said second unit and a hook on said first unit designed to engage said rod, and said second unit being provided with guide means guiding said rod for movement along a predetermined direction, said gripping means being provided with receiving means receiving said rod for sliding movement relative to said gripping means.

2. An arrangement as defined in claim 1, wherein said second unit has an inlet region for the articles and said inlet region is arranged to be located externally of the bath when said second unit engages said first unit.

3. An arrangement as defined in claim 2, wherein said second unit comprises respective directing means in said outlet and inlet regions for guiding the articles.

4. An arrangement as defined in claim 3, wherein said directing means comprise conveying roller pairs.

5. An arrangement as defined in claim 2, wherein said second unit comprises directing means in said inlet region for guiding the articles.

6. An arrangement as defined in claim 1, wherein said second unit comprises directing means in said outlet region for guiding the articles.

7. An arrangement as defined in claim 1, wherein said first unit is designed to be immersed in the bath from above and said second unit is designed to be situated on top of said first unit.

8. An arrangement as defined in claim 1, wherein said transporting means comprises a plurality of transporting roller pairs.

9. An arrangement as defined in claim 1, wherein said transporting means defines an approximately U-shaped path for the articles.

10. An arrangement as defined in claim 1, wherein said coupling means is designed so that said units are unlocked in response to a force urging said units apart and locked in response to a force urging said units together.

11. An arrangement as defined in claim 1, wherein said guide means is designed to guide said rod for horizontal movement.

12. An arrangement as defined in claim 1, wherein said guide means comprises a guide slot.

13. An arrangement as defined in claim 1, wherein said receiving means is designed so that relative sliding movement of said rod and said gripping means occurs along an inclined path.

14. An arrangement as defined in claim 13, wherein said path is upwardly and outwardly inclined as considered in a direction from the center towards a side of said gripping means.

15. An arrangement as defined in claim 1, wherein said receiving means comprises a receiving slot.

16. An arrangement as defined in claim 1, wherein said gripping means comprises a substantially flat section and said receiving means includes an inclined receiving slot in said flat section.

17. An arrangement as defined in claim 1, wherein said gripping means comprises a pair of gripping sections arranged at opposite sides of said second unit.

18. An arrangement as defined in claim 1, wherein said coupling means is designed so that said units are unlocked when said gripping means is manipulated to disengage said units and locked when said gripping means is manipulated to engage said units.

19. An arrangement as defined in claim 1, wherein said gripping means comprises a guide section for guiding the same relative to said remainder of said second unit.

20. An arrangement as defined in claim 1, wherein said gripping means and said remainder of said second unit are relatively movable along a vertical direction.

21. An arrangement as defined in claim 1, said first unit including first drive means for said transporting means; and wherein said second unit comprises movable directing means for guiding the articles, and second drive means for said directing means, said first and second drive means being designed to be coupled to one another when said units are in engagement.

22. An arrangement as defined in claim 21, wherein said directing means comprises a conveying roller pair in said outlet region.

23. An arrangement as defined in claim 21, said second unit having an inlet region for the articles, and said inlet region being arranged to be located externally of the bath when said second unit engages said first unit; and wherein said directing means comprises a conveying roller pair in said inlet region.

* * * * *